US010634145B2

(12) United States Patent
Anderson et al.

(10) Patent No.: US 10,634,145 B2
(45) Date of Patent: Apr. 28, 2020

(54) SELF-PRIMING PUMP ASSEMBLY

(71) Applicant: GEA Tuchenhagen GmbH, Büchen (DE)

(72) Inventors: Simon Anderson, Halstenbek (DE); Stephan Dirks, Schwarzenbek (DE); Christoph Wabnitz, Wiebendorf (DE)

(73) Assignee: GEA Tuchenhagen GmbH, Büchen (DE)

( * ) Notice: Subject to any disclaimer, the term of this patent is extended or adjusted under 35 U.S.C. 154(b) by 350 days.

(21) Appl. No.: 15/580,788

(22) PCT Filed: Jun. 3, 2016

(86) PCT No.: PCT/EP2016/062665
§ 371 (c)(1),
(2) Date: Dec. 8, 2017

(87) PCT Pub. No.: WO2016/198334
PCT Pub. Date: Dec. 15, 2016

(65) Prior Publication Data

US 2018/0340523 A1 Nov. 29, 2018

(30) Foreign Application Priority Data

Jun. 8, 2015 (DE) ..... 10 2015 007 100

(51) Int. Cl.
*F04D 9/00* (2006.01)
*F04D 9/04* (2006.01)
*F04D 29/42* (2006.01)

(52) U.S. Cl.
CPC ..... *F04D 9/005* (2013.01); *F04D 9/041* (2013.01); *F04D 29/428* (2013.01); *F05D 2250/52* (2013.01)

(58) Field of Classification Search
CPC ... F04D 9/04; F04D 9/041; F04D 9/05; F04D 9/06; F04D 13/02; F04D 29/426; F04D 29/428; F04B 23/08
See application file for complete search history.

(56) References Cited

U.S. PATENT DOCUMENTS 5,228,831 A * 7/1993 Becker ..... F04D 29/426 415/206
2002/0034446 A1 3/2002 Sutton

FOREIGN PATENT DOCUMENTS

AT 158125 B 3/1940
DE 102007032228 * 1/2009 ..... F04D 9/04
(Continued)

*Primary Examiner* — Kenneth J Hansen
(74) *Attorney, Agent, or Firm* — Young Basile Hanlon & MacFarlane, P.C.

(57) ABSTRACT

A self-priming pump assembly comprises a series connection of a liquid ring pump functioning as a rotating displacement pump and a normally-priming centrifugal pump. The self-priming pump assembly improves the fluid mechanics conditions for the flow of fluids toward and into a return line through the inclusion of a first connection opening in the meridian plane of the centrifugal pump that possesses a bulge enclosing a sector of the longitudinal axis of the first connection opening, where the bulge is one-sided and oriented toward a rotary axis of the pump assembly, and the bulge continuously expands, directly or indirectly, the first connection opening toward the impeller plane. At its end section facing the impeller plane, a transitional surface of the bulge continuously transitions into the lateral boundary surface, or an inner peripheral wall of the ring channel adjoining the lateral boundary surface.

20 Claims, 6 Drawing Sheets

(56) References Cited

FOREIGN PATENT DOCUMENTS

| | | | |
|---|---|---|---|
| DE | 102007032228 | A1 | 1/2009 |
| EP | 0936356 | A1 | 8/1999 |
| EP | 1191228 | A2 | 3/2002 |
| GB | 1292194 | A | 10/1972 |
| JP | H01203696 | A | 8/1989 |
| WO | 2009007075 | A2 | 1/2009 |

* cited by examiner

SELF-PRIMING PUMP ASSEMBLY

TECHNICAL FIELD

The invention relates to a self-priming pump assembly that comprises a series connection of a liquid ring pump functioning as a rotating displacement pump and a normally-priming centrifugal pump. In this context, the invention relates in particular to a liquid-conducting return line that connects a ring channel of the centrifugal pump to an inner space of the displacement pump, wherein the return line discharges on the ring channel side via a first connection opening arranged in the lateral boundary surface of the ring channel running laterally to the impeller plane.

BACKGROUND

A self-priming pump is known from DE 10 2007 032 228 A1 and from the subsequently filed WO 2009/007075 A1. With this known pump assembly, the evacuation of the intake side region of the normally-priming centrifugal pump that is necessary for drawing a liquid is realized by the rotating displacement pump upstream from the centrifugal pump. When there is sufficient liquid reservoir in the housing, the rotating displacement pump, which is designed as a so-called liquid ring pump, is able to convey gas, and can accordingly evacuate an upstream process arrangement and draw and convey liquid, or a two-phase stream consisting of a liquid and gas. Once liquid is drawn and enters in the displacement pump and hence the downstream centrifugal pump, flooding the latter, the centrifugal pump basically takes over conveying the liquid or, possibly within limits, the two-phase stream corresponding to its delivery characteristic influenced by the flow loss in the upstream displacement pump.

For continuous availability, the displacement pump always requires the aforementioned sufficient liquid reservoir before an evacuation of the process arrangement connected at the intake side that may become necessary so that the delivery chamber formed by its screw conveyor can ensure the required transport of gas if necessary. In addition to the supply by the intake line of the pump assembly, this liquid reservoir is also fed and maintained by a return line for fluid that on the one hand establishes a connection between a pressure-side interior space of the centrifugal pump (a first connection point, or respectively first connection opening) downstream from the impeller viewed in the direction of flow, and on the other hand the inner space of the housing or the intake port of the displacement pump, or the intake line connected to the latter (a second connecting point, or respectively second connection opening).

Because the liquid reservoir of the positive displacement pump is fed by the return line, it is desirable and advantageous if this return line is primarily supplied with fluid. The delivery of fluid in the return line is, however, necessarily a reflection of the amount of available fluid at the first connecting point, or respectively first connection opening of the return at the pressure-side inner space. Depending on the respective processing conditions, each two-phase stream formed from liquid and gas in given proportions of exclusively liquid up to exclusively gas is delivered by the pump assembly, and hence by the centrifugal pump as well, in the region of the aforementioned pressure-side inner space so that the familiar return line is also necessarily supplied with this respective two-phase stream.

It is known to connect to the return line to the ring channel, which is an integral part of the pressure-side inner space, and to provide the first connection opening in this regard in a lateral boundary surface oriented radially or almost radially, that is part of the rear housing part and borders the face of the ring channel in an axial direction in the form of ring surface. In this ring channel, which can be designed as a spiral ring channel or also as a bladeless ring chamber with a constant passage cross-section, the flow is delayed. This delay converts part of the kinetic energy of the flow leaving the impeller into static pressure so that the overall static pressure rises in the spring channel. A sufficient level of static pressure relative to the static pressure in the displacement pump is needed to transport fluid in the return line. With this arrangement of the first connection opening in the above-described radially, or approximately radially, oriented lateral boundary surface, the fact is exploited that fluid is preferably located in this region, at least with a two-phase stream that is not overly critical, and can be "harvested" there since gas components avoid the rear-most end face wall region of the ring channel, viewed in an axial direction, or bladeless channel if possible.

It is moreover known to position the first connection opening with respect to the pressure port of the centrifugal pump such that an arrangement plane that passes through a radial direction vector that, on the one hand runs through the midpoint of the first connection opening and, on the other hand, through the rotary axis of pump assembly, is penetrated at a right angle by the longitudinal axis of the pressure port. It is preferable because it is recommendable in terms of production to arrange a longitudinal axis of the first connection opening, or respectively the return line, centrally, or nearly centrally, relative to the radial area of extension of the lateral boundary surface.

BRIEF SUMMARY

Nonetheless, the improved harvesting of fluid in the region of the connection opening, in particular in its inflow and inlet region, remains an ongoing goal. Moreover, due to the gas admixtures that are necessarily harvested with the two-phase stream, additional flow losses occur at the inlet region and the directly following pipe region of the return line. In conjunction with the homogenization effect in the return line, the additional flow losses disadvantageously affect the supply of the displacement pump and hence ultimately the suction capacity of the overall pump assembly.

It is the object of the present invention to develop a self-priming pump assembly such that the fluid mechanics conditions for the flow of fluids toward and into the return line are improved.

The invention is based on a self-priming pump assembly that constitutes a series connection of a liquid ring pump functioning as a rotating displacement pump and a normally-priming centrifugal pump. The centrifugal pump has a rotatably mounted shaft with an impeller in a housing provided with an inlet opening and a pressure port. Viewed in the direction of flow, the housing preferably consists of a front and rear housing part and, in addition to the region accommodating the impeller, forms a ring channel that encloses the region of the impeller radially to the outside, either in the impeller plane and/or in at least one axially adjacent region. The inlet opening is arranged coaxial in the front housing part, wherein an inner space bordered by a housing casing of the displacement pump is connected by the inlet opening to an intake-side inner space of the centrifugal pump. A screw conveyor is arranged in the housing casing and is attached to the shaft extending through the impeller and engaging in the housing casing. A fluid-conducting return line is provided that connects the ring channel to the inner space, wherein the return line discharges at the ring channel side through a first connection opening that is arranged in a lateral boundary surface of the ring channel running lateral to the impeller plane.

The first connection opening possesses a bulge enclosing a sector of the longitudinal axis of the first connection opening. The bulge is one-sided and oriented toward the center of the pump assembly, and it continuously expands, directly or indirectly, the first connection opening toward the ring channel. At its end section facing the ring channel, a transitional surface of the bulge continuously transitions into the lateral boundary surface, or into an inner peripheral wall of the ring channel adjoining the lateral boundary surface.

The feature of the "continuous" expansion or "continuous" transition should be understood within the meaning of the known types of mathematical continuity. This means that a transition curve that represents an associated transitional surface per se within a given cross-section is composed of small pieces or curve segments. This composition is subject to the requirement that the curves within the individual segments be continuous, and conditions of continuity apply at the connecting points. As a result, this ensures impact-free entry of the flow into the first connection opening, and hence into the return line as well.

Unpredictably, in interaction with the peripheral speed in the ring channel on the one hand and a first secondary flow forming as a result of the curved flow in the ring channel and an opposite, secondary flow on the other hand, a reduced speed at the inlet region to the first connection opening results. This reduction in speed results from a recirculating flow at the inlet region to the first connection opening, which more or less causes a dead water region to form. The recirculation flow is shifted radially in the bulge, and the dead water region—a first flow region—that results from this flow effect is positioned at the edge of the ring channel. Consequently, this improves the inflow conditions at the region of the first connection opening. The reduction in speed at the inlet region moreover causes an increase in the static pressure there which, in comparison to prior art solutions, increases the pressure differential causing the flow in the return line, and reduces the suction time of the pump assembly.

Furthermore, the invention brings about a reduction of the swirling of the flow in the return line. This reduced turbulence that in particular is demonstrable in the pipe region of the return line directly adjoining the inlet region reduces the flow loss and homogenization effect in the return line (mixing, fragmentation and distribution of the gas admixtures in the liquid), which further reduces the suction time and further improves the supply of the displacement pump.

In a preferred embodiment of the housing of the centrifugal pump, the front housing part has a circular outer ring channel housing wall that extends in a substantially cylindrical manner and forms an outer peripheral wall of the ring channel, and has the pressure port discharging from the latter which is tangentially connected to the outer ring channel housing wall. The rear housing part has the inner ring channel housing wall that forms the inner peripheral wall of the ring channel and preferably runs parallel to the outer ring channel housing wall. The ring channel is formed in a region axially adjacent to the impeller plane that, viewed in the direction of flow, lies after the impeller and exclusively outside of the region covered by the impeller. The lateral boundary surface is part of the rear housing part, which is preferably aligned radially, and which borders the ring channel in an axial direction as the rear-most end face wall region.

In all of the above-defined embodiments of the housing of the centrifugal pump, the flow conditions toward, and the entry conditions in the first connection opening, and hence in the return line, are further improved. The recirculation flow is enhanced and sustainably generated when, as provided, the first connection opening to the ring channel is initially expanded in the form of a countersink. In this embodiment, the bulge enters the countersink, or passes through the countersink in an axial direction, which results in a continuous cross-sectional expansion of the described region of the ring channel. If the bulge only enters the countersink, then only the countersink expands toward the ring channel. If it passes through the countersink, then already the first connection opening expands toward the ring channel, viewed in the direction of flow of the return line. In this context, the countersink can be entirely or only partially covered in a radial direction by the bulge. The countersink can for example be designed tapered, cone shaped, conical in the broadest sense or tulip-shaped. It is preferably designed axially symmetrical and coaxial to the longitudinal axis of the first connection opening, which significantly simplifies its machining.

A further improvement of the flow conditions toward and inflow conditions into the first connection opening and hence the return line results when, as provided in another suggestion, the longitudinal axis of the first connection opening is arranged eccentrically offset to the radial area of extension of the lateral boundary surface, and radially offset inward. This measure further contributes to the reinforcement and sustained generation of the above-described recirculation flow. In conjunction with the above-defined radial offset of the longitudinal axis, it is moreover advantageous when the longitudinal axis is at a distance of up to one-half the diameter of the return line from the inner peripheral wall bordering the ring channel radially to the inside. Consequently, the bulge and/or the countersink, when the inner peripheral wall is provided with a suitable inclination relative to the longitudinal axis, engage in the inner ring housing wall. This engaging, in terms of fluid dynamics, positively influences the recirculation flow and hence the flow conditions toward and entry conditions into the first connection opening, and hence into the return line.

A preferred embodiment of the invention provides that the longitudinal axis of the first connection opening is perpendicular to, and in the contact point of the tangent to, the lateral boundary surface. This embodiment establishes particularly simple geometric conditions in light of the connection of the return line to the ring channel when the lateral boundary surface of the ring channel is aligned radially.

Given a radially aligned lateral boundary surface, another suggestion provides that an axis of symmetry of the bulge forms an angle with the longitudinal axis of the first connection opening perpendicular to the lateral boundary surface, wherein the axial direction of extension of the bulge is oriented radially inward. This embodiment further improves the flow conditions toward and flow conditions into the first connection opening and hence into the return line because it counteracts a contraction of the flow in the region of the first connection opening by additionally expanding the first connection opening. Furthermore, this realizes the continuous transition from the bulge into the adjacent inner peripheral wall of the ring channel basically without an additional shaping measure.

The above-described positive effects associated with a radially-aligned lateral boundary surface are further reinforced when, as it is also proposed, a low point of the bulge recedes radially to the inside behind the inner peripheral wall viewed in the direction toward the center of the pump assembly, and when the transitional surface of the bulge continuously transitions into the inner peripheral wall.

These above-described measures for designing the bulge, countersink and radial arrangement of the first connection opening are, on the one hand, relatively easy to produce by machining, and are particularly effective in terms of fluid mechanics on the other hand when the inner and outer peripheral wall of the ring channel run parallel, or approximately parallel, to each other, and the ring channel is bordered at its end facing away from the impeller plane by a radially aligned lateral boundary surface.

Another embodiment provides that the longitudinal axis of the first connection opening, viewed in the direction of flow of the return line, is oriented radially to the inside toward the center of the pump assembly. This embodiment can be applied to any geometric shape of the ring channel, as well as to parallel peripheral walls in conjunction with a radially aligned lateral boundary surface. In any case, it improves the impact-free entrance of the flow into the return line because the described inclination of the longitudinal axis evokes a similar fluid mechanics effect like the above-described inclination of the axis of symmetry of the bulge.

One advantageous embodiment provides that the first connection opening, viewed in a cross-sectional plane perpendicular to the rotary axis of pump assembly, is positioned relative to the pressure port such that a first arrangement plane that passes through a radial directional vector which, on the one hand, runs through the midpoint of the first connection opening and, on the other hand, runs through the rotary axis of the pump assembly, is penetrated at a right angle by the longitudinal axis of the pressure port.

Another advantageous embodiment proposes that, given the above-defined perspective, the first connection opening is positioned relative to the pressure port such that a second arrangement plane that passes through a radial directional vector which, on the one hand, runs through the midpoint of the first connection opening and, on the other hand, runs through an axial axis of symmetry of the housing jacket, is penetrated at a right angle by the longitudinal axis of the pressure port.

The position of the first connection opening defined in this manner means that a location in the ring channel directly before the entry of the flow into the pressure port of the centrifugal pump is selected at which the maximum possible static pressure exists within the housing of the centrifugal pump. Of course, the first connection opening can also be arranged between the first and second arrangement plane, or in a narrow sectoral region adjacent to these arrangement regions viewed in the peripheral direction without departing from the invention.

BRIEF DESCRIPTION OF THE DRAWINGS

A preferred exemplary embodiment of the self-priming pump assembly according to the invention is depicted in the drawing and will be described below.

DETAILED DESCRIPTION

Figure 1:
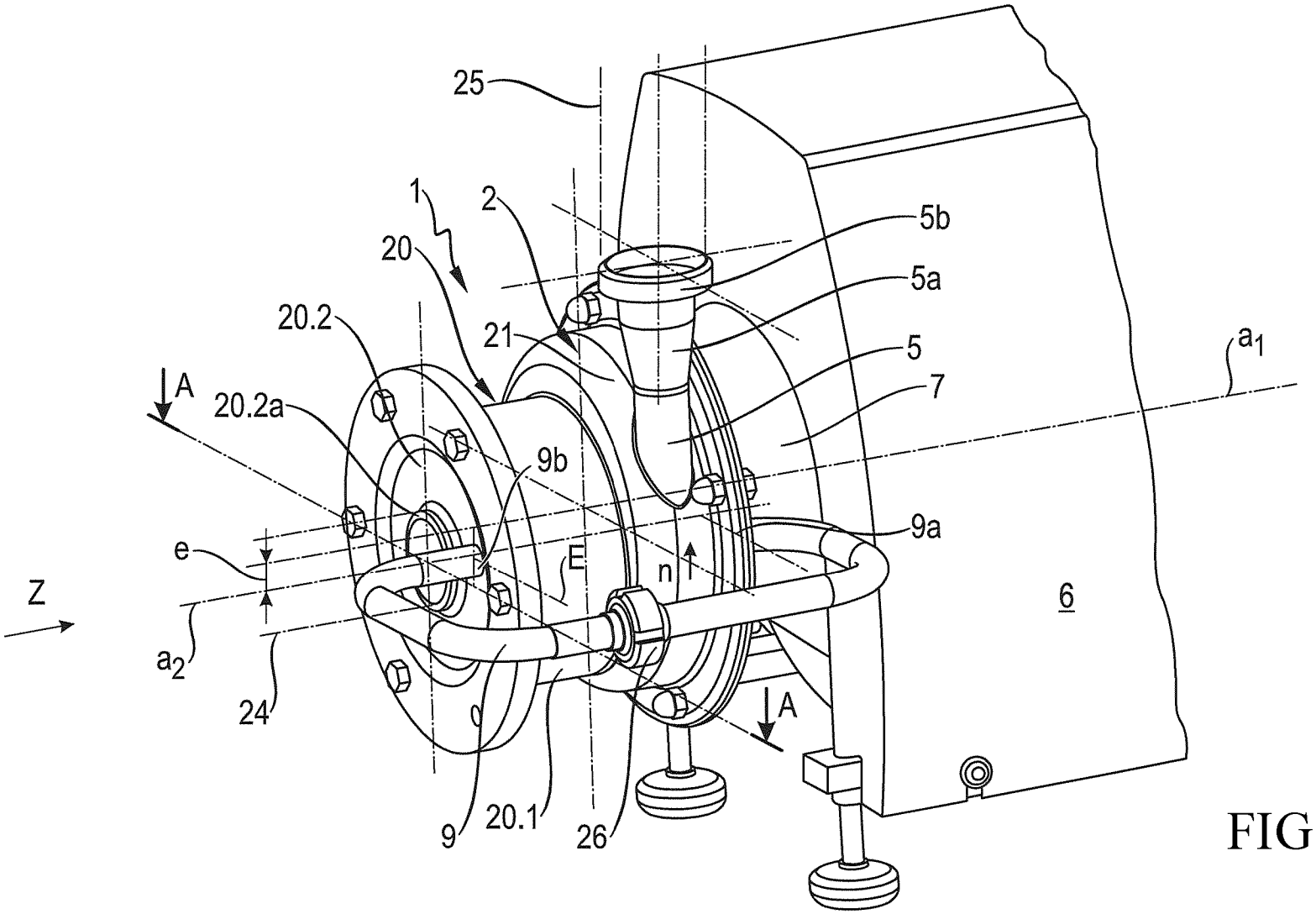
FIG. 1 shows a perspective view of the self-priming pump assembly according to an embodiment of the invention.

A self-priming pump assembly 1 (FIGS. 1 to 3) is formed by a normally-priming centrifugal pump (rotary pump) 2 and, viewed in the direction of flow, an upstream rotating displacement pump 20, which is designed as a so-called liquid ring pump in the exemplary embodiment. The displacement pump 20 is bordered on the housing side by a housing casing or jacket 20.1 (FIGS. 2, 1) and a housing cover 20.2 with a suction port 20.2*a* arranged centrally on the latter, wherein the housing jacket 20.1 is securely connected to a front housing part 2.1 of the centrifugal pump 2 at its end facing away from the housing cover 20.2.

An axial axis of symmetry a2 of the housing jacket 20.1 is offset by a vertical eccentricity e relative to a rotary axis al of the pump assembly 1 (see FIGS. 1 and 3), with respect to the placement of the pump assembly 1 in the drawing, which also corresponds to the normal installation position. Consequently, a screw conveyor 21 located in the displacement pump 20 and arranged on a shaft extension 8*b* of a shaft 8 bearing an impeller 4 of the centrifugal pump 2 is offset upward by this vertical eccentricity e within the housing jacket 20.1. The shaft extension 8*b* abuts a hub 8*a* of the shaft 8, wherein the impeller is fastened to the hub 8*a*, and extends through the front housing part 2.1 and into the housing jacket 20.1. An inner space 20.3 bordered on the inside by the housing jacket 20.1, the housing cover 20.2 and the front housing part 2.1 is fluidically connected, via an inlet opening 2.1*b* (FIG. 2) arranged concentrically in the front housing part 2.1 and hence concentric to the rotary axis al, to the suction side inner space 2.1*c* of the centrifugal pump 2.

Figure 2:
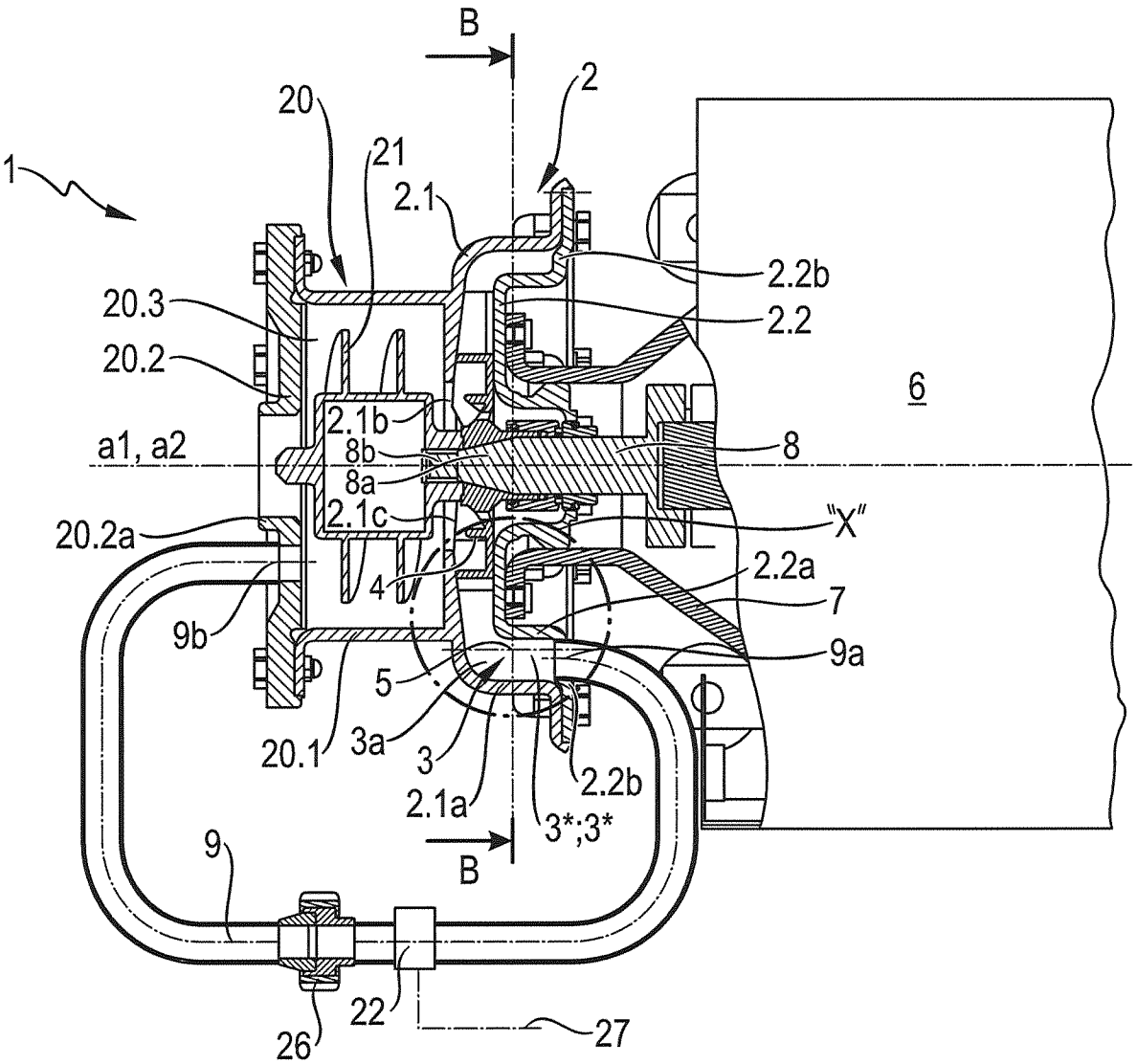
FIG. 2 shows a meridian section of the pump assembly according to FIG. 1 corresponding to a section identified therein with A-A.

The design of the centrifugal pump 2 is for example known from DE 103 14 425 B4. A housing 2.1/2.2 of the centrifugal pump 2 consisting of the front 2.1 and a rear housing part 2.2 is fastened overhung by a fastening flange 7 to a motor 6 (FIGS. 1 and 2). The inlet opening 2.1*b* is formed centrally in the front housing part 2.1, and a pressure port 5 is connected to its perimeter and tangentially discharges there and terminates across a conical expansion 5*a* in a connection port 5*b*.

Figure 3:
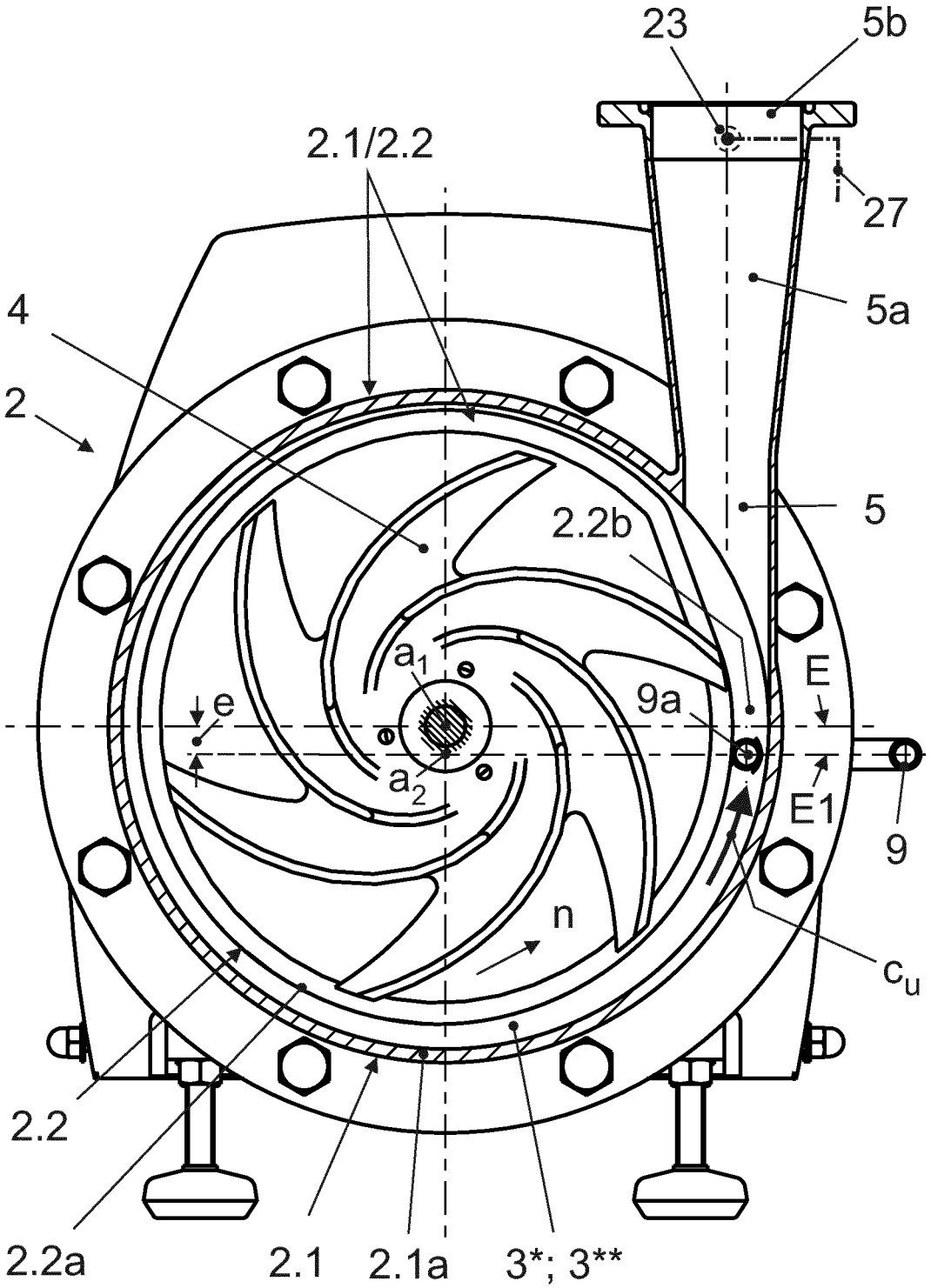
FIG. 3 shows a cross-section of the centrifugal pump of the pump assembly according to FIG. 1 corresponding to a section that is moved forward axially relative to the section drawn in FIG. 2 with B-B such that the rear housing part is not cut, wherein the impeller arranged before the sectional plane is also presented.
Figure 5:
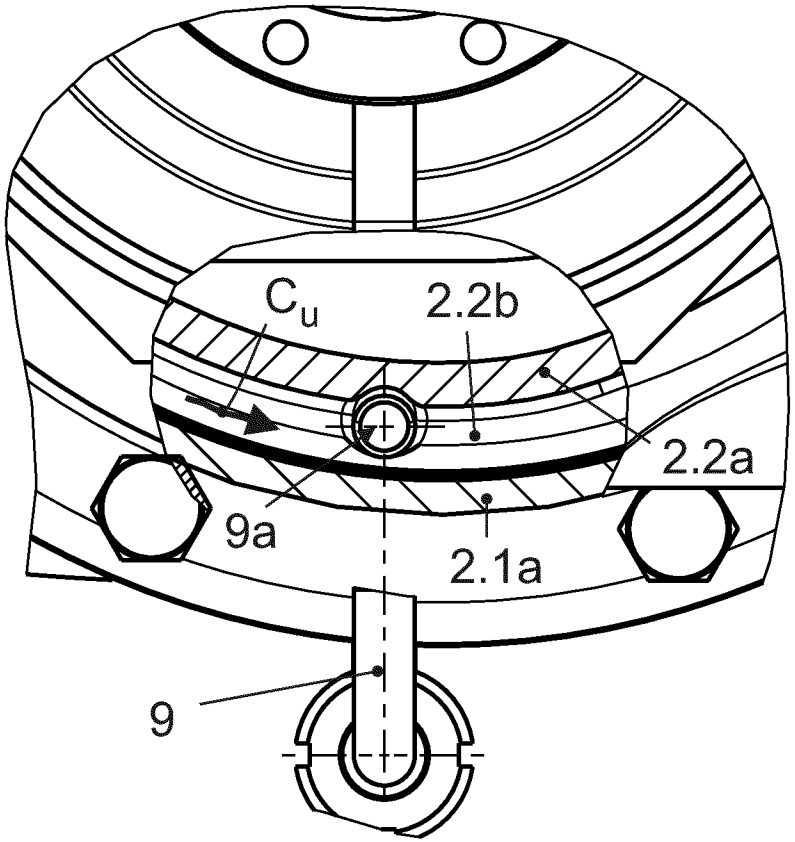
FIG. 5 shows a side view of the arrangement according to FIG. 4.
Figure 4:
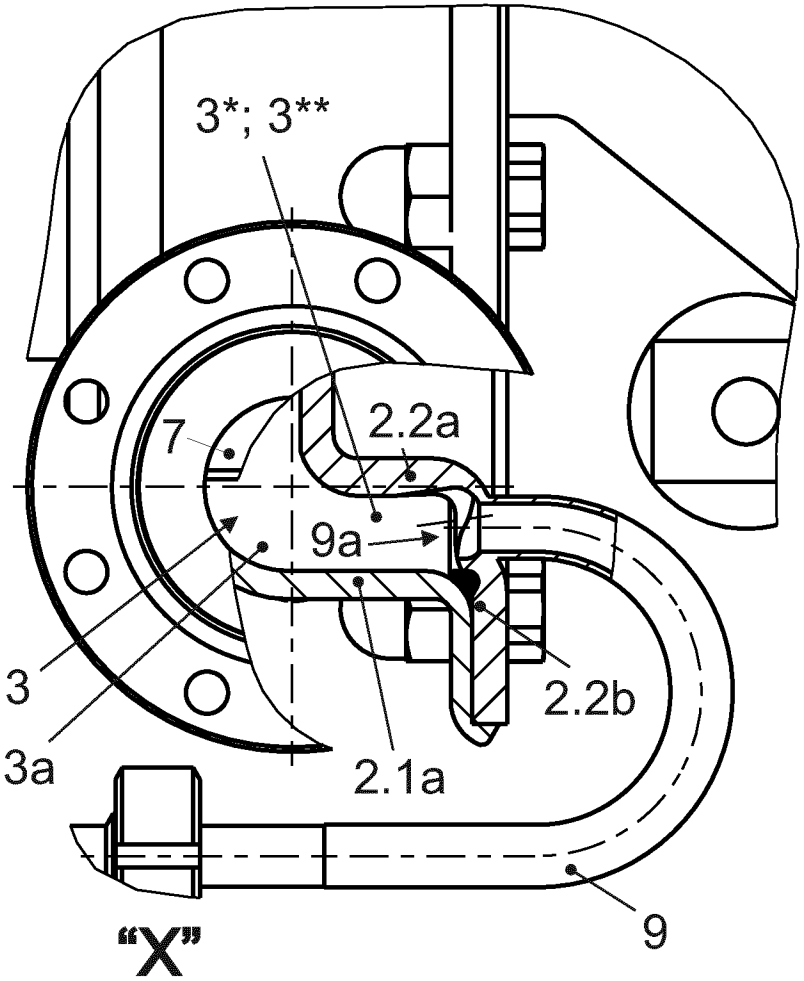
FIG. 4 shows a half section and half view of a detail drawn in FIG. 2 with "X" in the region of the ring channel and a part of the adjoining return line.

The meridian section according to FIG. 2 results from the section drawn in FIG. 1 with A-A. The radially extending region of the front and rear housing part 2.1, 2.2 are each adapted to the impeller 4 with a narrow annular gap. A blade-free annular space 3*a* adjoins the outside of the annular peripheral impeller discharge cross-section and is initially bordered somewhat, in a radial direction on both sides, by the front and rear housing part 2.1, 2.2, and is then bounded on the outside by a transitional surface of the front housing part 2.1 (not shown). The transitional surface then continues in an outer ring channel housing wall 2.1*a*, wherein it has for example the shape of a cylinder jacket, at least on the inside, i.e., a constant curvature radius, an outer radius (FIG. 3). In the region of the impeller 4, the rear housing part 2.2 is preferably designed as a radially extending disc. A primarily axially-oriented inner ring channel housing wall 2.2*a* extending from the impeller 4 in an axial direction and enclosing the rotary axis al follows in the outer region of this disc, and its local curvature radius (changeable local inner radius; FIG. 3) can be changed to realize for example a spiral path over the perimeter.

The outer and inner ring housing wall 2.1*a*, 2.2*a* accordingly form a ring channel 3* between themselves that can be designed as a spiral ring channel 3 with a continuously changing passage cross-section (changeable local curvature radius). Likewise, a ring channel 3* with a constant passage cross-section over the perimeter can be realized with the portrayed arrangement. The ring channel 3* (or alternatively the spiral ring channel 3**) laterally adjoins the blade-free annular space 3***a*; together they form a pressure-side inner space 3 of the centrifugal pump 2.

FIG. 3 shows an example of how the spiral ring channel 3 continuously expands viewed over the perimeter. Starting with the rearmost point of penetration of the pressure port 5 with the front housing part 2.1 viewed in a rotary direction n of the rotary pump 2, the passage cross-section of the spiral ring channel 3** continuously increases from a minimum cross-section up to a point where, in FIG. 3, the horizontal midline intersecting the rotary axis al forms a perpendicular with the longitudinal axis of the pressure port 5. Up to this point, the inner ring channel housing wall 2.2***a* curves continuously. This is preferably subsequently adjoined by a flat wall region (not shown) that ensures a passage cross-section in the region of the spiral ring channel 3 that corresponds at least to the passage cross-section of the pressure port 5. Instead of the flat wall region, the inner ring channel housing wall 2.2***a* can for example be designed continuously curved, even in another shape.

The outer axial limit of the ring channel 3* or the spiral ring channel 3 is realized by a lateral boundary surface 2.2***b* that adjoins the inner ring channel housing wall 2.2*a*, recedes from the rotary axis al in a radial direction, runs laterally to the impeller plane and is part of the rear housing part 2.2 (FIG. 2). The lateral boundary surface 2.2*b* is preferably aligned radially and bounds the ring channel 3*, 3** in an axial direction as the rearmost endface wall region.

The lateral boundary surface 2.2*b* preferably continues beyond the outermost radial extension of the outer ring channel housing wall 2.1*a* in a radial direction (FIG. 2). A radially oriented ring surface (not shown) that corresponds with and is releasably connected to the lateral boundary surface 2.2*b* also adjoins the outside of the outer ring channel housing wall 2.1*a* and comprises the lateral boundary surface 2.2*b* on the outside. The two radially oriented aforementioned surfaces are sealed from each other on the ring channel side (housing seal 28, FIG. 6) and have a plurality of through-holes arranged over their perimeter that correspond with each other, and through which the front and rear housing part 2.1, 2.2 are preferably screwed to each other.

A return line 9 (FIGS. 2, 1, 3) is connected on the centrifugal pump side via a connection opening 9*a* to the ring channel 3* or the spiral ring channel 3. A preferred arrangement location for the first connection opening 9***a* is the radially-oriented lateral boundary surface 2.2*b* that is part of the rear housing part 2.2 and borders the end face of the ring channel 3*, 3 in a radial direction, i.e., the ring channel 3*, 3** discharges there into the first connection opening 9***a*.

Best results are achieved when the first connecting opening 9*a* is positioned with reference to the pressure port 5 such that a first arrangement plane E (see FIG. 3) that passes through a radial directional vector which runs on the one hand through the midpoint of the first connection opening 9*a* and on the other hand through the rotary axis al of the pump assembly 1 is penetrated at a right angle by the longitudinal axis of the pressure port 5. Comparable results are ensured when, instead of the first arrangement plane E, a second arrangement plane E1 is chosen that is offset relative to the first arrangement plane E by the vertical eccentricity e. In this case, the first connection opening 9*a* is positioned with reference to the pressure port 5 such that the second arrangement plane E1 that passes through a radial directional vector which runs on the one hand through the midpoint of the first connection opening 9*a* and on the other hand through an axial axis of symmetry a2 of the housing jacket 20.1 is penetrated at a right angle by the longitudinal axis of the pressure port 5. Of course, the first connection opening 9*a* can also be arranged between the first and second arrangement plane E1, E2, or in a narrow sectoral region adjacent to these arrangement regions E1, E2 viewed in the peripheral direction of the centrifugal pump 2 without departing from the invention.

The return line 9 is connected by a second connection opening 9*b* to the inner space 20.3. The second connection opening 9*b* can be arranged in the housing jacket 20.1, or the housing cover 20.2, or the suction port 20.2*a*, or a suction line 24.

For the sake of easier assembly, the return line 9 is preferably divided between the two connection openings 9*a*, 9*b*, and the ends are connected to each other by a screwed connection 26. In order to shut off the return line 9 fluid-tight, a shutoff valve 22 is arranged therein that is remotely controllable in a preferred embodiment. The remotely controllable shutoff valve 22 is connected by a control line 27 to a signal transmitter 23 that is for example arranged in the pressure port 5 or a pressure line 25 and generates a control signal consisting of a physical quantity for characterizing the fluid delivery in the pump assembly 1 (FIGS. 2, 3).

FIGS. 2 and 4 to 7 show a preferred embodiment of the housing 2.1, 2.2 and the ring channel 3*, 3 of the centrifugal pump 2. The front housing part 2.1 (FIGS. 6, 2) has the circular outer ring channel housing wall 2.1***a* that extends in a substantially cylindrical manner and forms an outer peripheral wall 29 of the ring channel 3*, 3, and has the pressure port 5 discharging from the ring channel housing wall 2.1***a* that is tangentially connected to the outer ring channel housing wall 2.1*a*. The rear housing part 2.2 has the inner ring channel housing wall 2.2*a* that forms the inner peripheral wall 30 of the ring channel 3*, 3 and preferably runs parallel to the outer ring channel housing wall 2.1***a*. The ring channel 3*, 3 is preferably formed in a region axially adjacent to the impeller plane that, viewed in the direction of flow, lies after the impeller 4 and exclusively entirely outside of the region covered by the impeller 4. The lateral boundary surface 2.2***b* is part of the rear housing part 2.2; it is preferably aligned radially, and borders the ring channel 3*; 3** in an axial direction as the rearmost end face wall region.

The advantageously designed features characterizing the invention will be presented in an example of the above-defined preferred embodiment of the housing 2.1, 2.2 and the ring channel 3*, 3 (FIGS. 4 to 7), and their operating principle will be explained. In the portrayed meridian plane (FIG. 6), the ring channel 3*, 3** possesses a local ring channel width s whose middle is defined by a half local ring channel width s/2. A longitudinal axis a3 of the first connection opening 9***a* is arranged eccentrically offset by a radial offset Δr to the lateral extending region of the lateral boundary surface 2.2*b*, and is arranged radially offset inward, wherein the latter is depicted as the front wall 31 within the ring channel 3*, 3**.

Figure 7A:
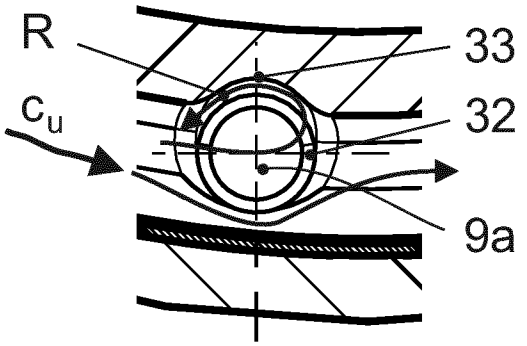
FIG. 7A shows the flow conditions in the region of the first connection opening transversely impinged upon by the peripheral flow speed in the ring channel.
Figure 7:
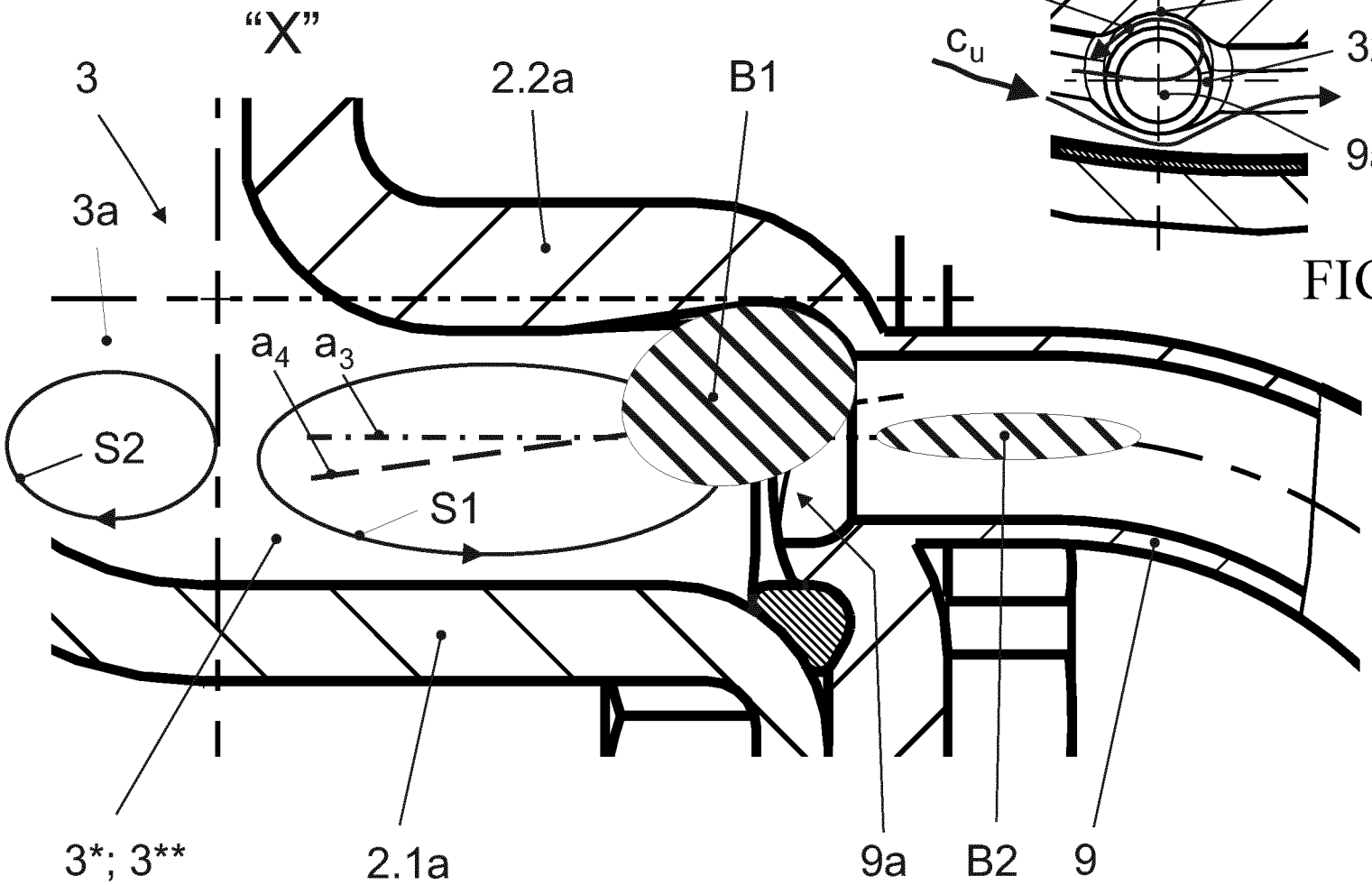
FIG. 7 shows an enlarged view of the arrangement according to FIG. 6 to illustrate fluid mechanics processes in the depicted region.

This arrangement unforeseeably yields a reduced speed in a first flow region B1 in interaction with a peripheral speed cu in the ring channel 3*, 3 (see FIGS. 3 and 5) on the one hand and a first secondary flow S1 forming as a result of the curved flow, and an opposite secondary flow S2 (FIG. 7) on the other hand. Viewed in the direction of flow of the return line 9, the first flow region B1 is in front of the inlet region to the first connection opening 9***a* and is radially shifted toward the bulge 33 designed and positioned according to this embodiment of the invention. In the first flow region B1, a dead water zone is basically formed at the edge in the ring channel 3*, 3. This dead water zone results from a recirculation flow R as shown in FIG. 7A, which originates and is generated by the bulge 33, and which significantly improves the flow conditions at the inlet region to the first connection opening 9***a*. The described reduction in speed moreover causes an increase in the static pressure there that, in comparison to prior art solutions, increases the pressure differential causing the flow in the return line 9, and reduces the suction time of the pump assembly 1.

Moreover, the bulge causes a reduction on the one hand of the number of swirls, and a decrease in their intensity in the return line 9 on the other hand. This reduced turbulence that in particular is demonstrable in the pipe region of the return line 9 directly adjoining the inlet region of the first connection opening 9*a*, a second flow region identified with B2 in FIG. 7, reduces the flow loss and homogenization effect in the return line 9 (mixing, fragmentation and distribution of the gas admixtures in the liquid). This flow loss and homogenization further reduces the suction time of the pump assembly 1 and further improves the supply of the displacement pump 20 with less gas-laden fluid. Due to the features according to this embodiment of the invention, the second flow region B2 is demonstrably slimmer with less narrowing of the cross-section than without these features.

Figure 6:
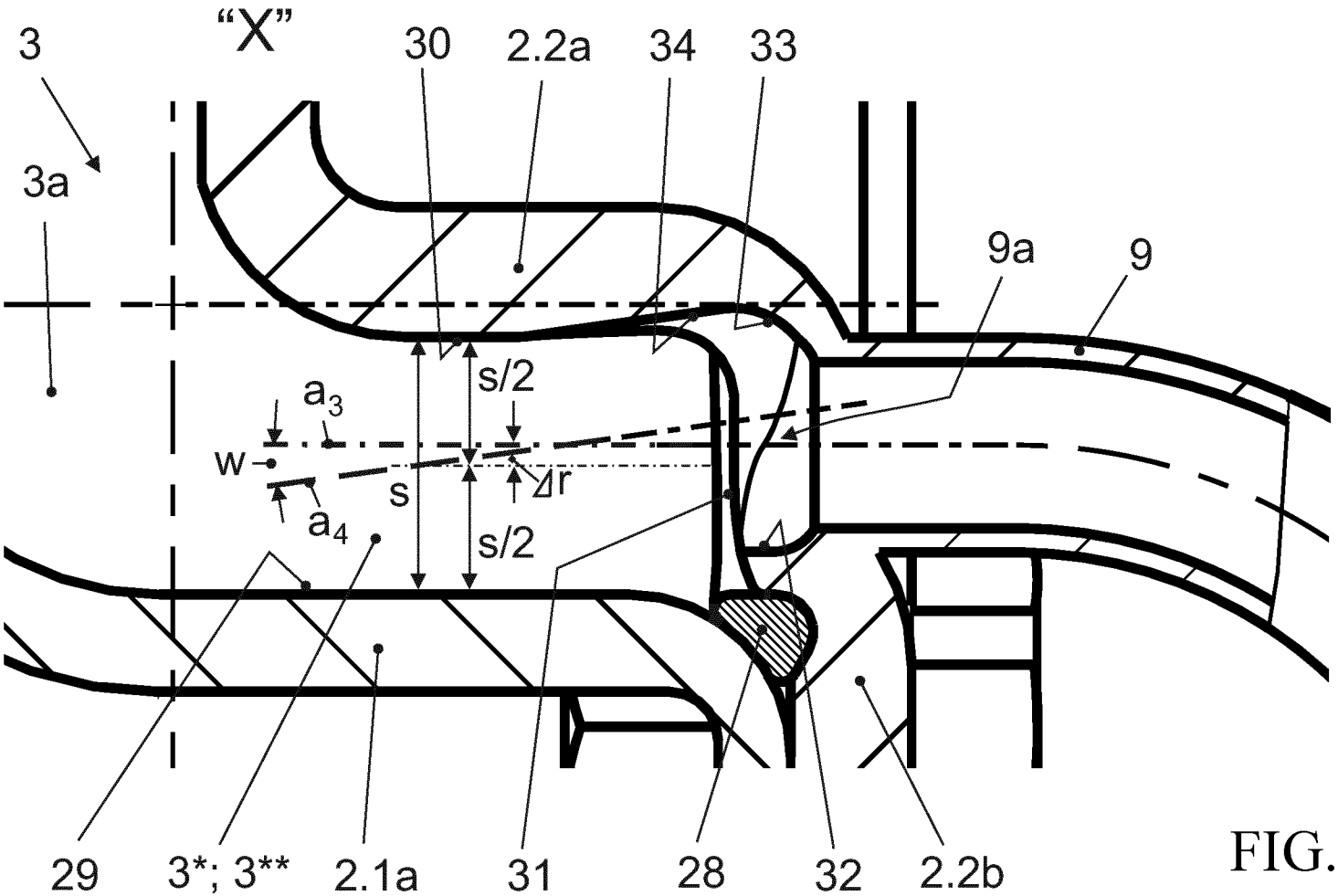
FIG. 6 shows an enlarged view of the detail drawn in FIG. 2 with "X", wherein the view of the meridian section is restricted by the ring channel and a part of the adjoining return line.

An advantageous embodiment provides that the first connection opening 9*a* toward the ring channel 3*, 3 initially expands in the shape of a countersink 32 (FIG. 6). In this context, the bulge 33 either engages only in the countersink 32 in an axial direction, or extends entirely therethrough into the first connection opening 9***a*, or respectively through the inner diameter of the return line 9. If the bulge 33 only axially enters the countersink 32, then only the countersink 32 expands toward the ring channel 3*, 3. If it passes through the countersink 32, then the first connection opening 9***a*, or respectively the inner diameter of the return line 9, expands toward the ring channel 3*, 3, viewed in the direction of flow of the return line 9. In this context, the countersink 32 can be entirely or only partially covered in a radial direction by the bulge 33. This countersink 32 can be designed tapered, conical or cone-shaped, or tulip-shaped, wherein the transition to the inner tube of the return line 9** is preferably designed rounded, i.e., preferably convexly curved in order to avoid restricting, or respectively at least reducing, the tubular flow.

A preferable machining of the countersink 32 is simplified when the latter is formed axially symmetrical and coaxial to the longitudinal axis a3. In this case, the ring-channel-side end section of the inner tube of the return line can for example serve as a guide for the machining tool.

A further improvement of the flow conditions toward and inflow conditions into the first connection opening 9*a* and hence the return line 9 (FIG. 6) results when the longitudinal axis a3 of the first connection opening 9*a* is arranged eccentrically offset to the radial area of extension of the lateral boundary surface 2.2*b*, and radially offset inward. The radial offset of the longitudinal axis a3 (FIG. 7, 7A) reinforces the formation of the recirculation flow R and also ensures its sustained generation.

In conjunction with the above-defined radial offset of the longitudinal axis a3, it is moreover advantageous when the longitudinal axis is at a distance of up to one-half the diameter of the return line 9 from the inner peripheral wall 30 bordering the ring channel 3*, 3 radially to the inside. Consequently, the bulge 33 and/or the countersink 32, when the latter is provided with a suitable inclination relative to the longitudinal axis a3, engage in the inner ring housing wall 2.2***a*. This engaging, in terms of fluid dynamics, positively influences the recirculation flow R and hence the flow conditions toward and entry conditions into the bulge 33, countersink 32, first connection opening 9*a*, and hence into the return line 9.

With regard to the direction of the discharge of the return line 9 from the ring channel 3*, 3, the invention provides cheap alternative variants. A first variant is distinguished in that the longitudinal axis a3 is perpendicular to, and in the contact point of the tangent to, the lateral boundary surface 2.2***b*. In a second variant, the longitudinal axis a3, viewed in the direction of flow of the return line 9, is oriented radially to the inside toward the center of the pump assembly 1.

The selection of the aforementioned two variants also depends on the path of the lateral boundary surface 2.2*b*. Centrifugal pump engineering is familiar with ring channels with a passage cross-section that is circular, oval, elliptical, trapezoidally expanded radially to the outside, rectangular or quadratic. The path of extension of the lateral boundary surface 2.2*b* resulting from the above cross-sectional shape to which the return line 9 is connected determines whether the flow can enter the first connection opening 9*a* to the return line 9 more or less free of impact. Impact-free entry can be established by changing the angle of inclination between the longitudinal axis a3 and the direction of the lateral boundary surface 2.2*b*. If for example the lateral boundary surface 2.2*b* is aligned radially, then, by using the second variant (orienting the longitudinal axis a3 radially to the inside), the degree to which the flow entering the return line 9 is deflected in the region of the first connection opening 9*a* can be reduced. If for example the ring channel 3*, 3 is designed circular, and if the first connection opening 9***a* is for example in the middle region of the first quadrant of the circular cross section of the ring channel 3*, 3, then the first variant (longitudinal axis a3 is perpendicular to, and in the contact point of the tangent to, the lateral boundary surface 2.2***b*) can be used because the longitudinal axis a3, viewed in the direction of flow of the return line 9, is already aligned radially inward per se.

If the embodiment of the ring channel 3*, 3 provides a radially aligned boundary surface 2.2***b*, it yields a further improvement in the flow conditions toward, and the entry conditions into, the first connection opening 9*a* by means of a proposal that provides that an axis of symmetry a4 of the bulge 33 forms an angle w with the longitudinal axis a3 perpendicular to the lateral boundary surface 2.2*b*, wherein the axial direction of extension of the bulge 33 is oriented radially inward.

The provided embodiment can be further optimized by another proposal in terms of fluid mechanics in that a low point of the bulge 33, viewed in the direction toward the center of the pump assembly 1, recedes inward behind the inner peripheral wall 30, and the transitional surface 34 of the bulge 33 transitions continuously into the inner peripheral wall 30.

The above described embodiments of the process assembly 1 contain the bulge 33, and/or the countersink 32, and/or the radial offset of the first connection opening 9*a* in accordance with the patent claims. All useful combinations of these inventive features can be implemented proceeding in each case from the realization of the bulge 33, and establish a solution that has advantages over the addressed relevant prior art. The bulge 33 for example can directly adjoin the first connection opening 9*a*, wherein the latter can be arranged radiantly offset from or in the middle of the ring channel 3*, 3. The ring channel 3*, 3** itself can be realized in the different axial positions with respect to the region covered by the impeller 4 that are set forth in the claims and also presented in the above description. The ring channel 3*, 3** is either designed as a blade-free ring channel 3* with a passage cross-section that is constant over the perimeter, or a ring channel 3** with a continuously changing passage cross-section. The cross-sectional shape of the ring channel 3*, 3**** can be designed circular, oval, elliptical, trapezoidally and radially expanding to the outside, rectangular or quadratic.

A list of references used in the drawings is described below.

1 Self-priming pump assembly
2 (Normally-priming) centrifugal pump
2.1/2.2 Housing
2.1 Front housing part
2.1A Outer ring channel housing wall
2.1*b* Inlet opening
2.1*c* Suction site inner space
2.2 Rear housing part
2.1A Inner ring channel housing wall
2.2*b* Lateral boundary surface
3 Pressure side inner space
3* Ring channel
3* Spiral ring channel
3*a* Blade-free annular space
4 Impeller
5 Pressure port
5*a* Conical expansion
5*b* Connection port
6 Motor
7 Fastening flange
8 Shaft
8*a* Shaft Hub
8*b* Shaft extension
9 (Liquid-conducting) return line
9*a* First connection opening
9*b* Second connection opening
20 Rotating displacement pump (equipment pump)
20.1 Housing jacket
20.2 Housing cover
20.2*a* Suction port
20.3 Interior space
21 Screw conveyor
22 Shutoff valve
23 Signal transmitter
24 Suction line
25 Pressure line
26 Screwed connection
27 Control line
28 Housing seal
29 Outer peripheral wall
30 Inner peripheral wall
31 Front wall
32 Countersink (conical; tulip-shaped)
33 Bulge
34 Transitional surface
$a_1$ Rotary axis of the pump assembly 1
$a_2$ Axial axis of symmetry of the housing jacket 20.1
$a_3$ Longitudinal axis of the first connection opening 9*a*
$a_4$ Axis of symmetry of the bulge 33
$c_u$ Peripheral speed in the ring channel 3*, 3**
e (Vertical) eccentricity
n Direction of rotation
s Local ring channel width
s/2 Half the local ring channel width
w Adjustment angle
B1 First flow region
B2 Second flow region
E First arrangement plane
E1 Second arrangement plane
R Recirculation flow
S1 First secondary flow
S2 Second secondary flow

The invention claimed is:

1. A self-priming pump assembly, comprising:

a rotating displacement pump; and a normally-priming centrifugal pump arranged in a series connection with the displacement pump, the centrifugal pump comprising a rotatably mounted shaft with an impeller in a housing provided with an inlet opening and a pressure port, wherein viewed in a direction of flow, the housing includes a front housing part and a rear housing part and forms a ring channel that encloses a region of the impeller radially to the outside the ring channel axially arranged in at least one of a plane of the impeller or an axially adjacent region, wherein the inlet opening is arranged coaxially on the front housing part, wherein an inner space bordered by a housing casing of the displacement pump is connected via the inlet opening to a suction side inner space of the centrifugal pump, and a screw conveyor is arranged in the housing casing and is attached to the shaft extending through the impeller and engaging in the housing casing, wherein a fluid-conducting return line connects the ring channel to the inner space, wherein the return line discharges at the ring channel through a first connection opening arranged in a lateral boundary surface of the ring channel running lateral to the plane of the impeller, wherein the first connection opening possesses a bulge enclosing a sector of a longitudinal axis of the first connection opening, wherein the bulge radially expands the first connection opening at a side of the longitudinal axis toward a center of the pump assembly, and wherein, at an end section of the bulge facing the ring channel, a transitional surface of the bulge continuously transitions into one of the lateral boundary surface or an inner peripheral wall of the ring channel adjoining the lateral boundary surface.

2. The self-priming pump assembly according to claim 1, wherein:

the front housing part includes a circular outer ring channel housing wall extending in a substantially cylindrical manner and forming an outer peripheral wall of the ring channel, the pressure port discharging from the outer ring channel housing wall and tangentially connected to the outer ring channel housing wall, the rear housing part includes an inner ring channel housing wall that forms the inner peripheral wall of the ring channel and runs parallel to the outer ring channel housing wall, the ring channel is formed in a region axially adjacent to the plane of the impeller which, viewed in the direction of flow, lies after the impeller and exclusively entirely outside of a region covered by the impeller, and the lateral boundary surface is part of the rear housing part and borders the ring channel in an axial direction as a rear-most end face wall region.

3. The self-priming pump assembly according to claim 2, wherein:

the first connection opening toward the ring channel initially expands in a shape of a countersink, at least one of the bulge engages in the countersink in an axial direction, or the bulge extends through the countersink and thereby continuously expands the countersink toward the ring channel, and the countersink is formed axially symmetrical and coaxial to the longitudinal axis.

4. The self-priming pump assembly according to claim 2, wherein:

the longitudinal axis is arranged eccentrically offset to a radial area of extension of the lateral boundary surface, and radially offset inward; and the longitudinal axis is at a distance of up to one-half a diameter of the return line from the inner peripheral wall bordering the ring channel radially to the inside.

5. The self-priming pump assembly according to claim 2, wherein:

the longitudinal axis is perpendicular to, and in a contact point of a tangent to, the lateral boundary surface.

6. The self-priming pump assembly according to claim 5, further comprising:

a radially aligned lateral boundary surface, wherein an axis of symmetry of the bulge forms an angle with the longitudinal axis perpendicular to the lateral boundary surface, and an axial direction of extension of the bulge is oriented radially inward.

7. The self-priming pump assembly according to claim 6, wherein:

a low point of the bulge, viewed in a direction toward the center of the pump assembly, recedes inward behind the inner peripheral wall, and the transitional surface of the bulge transitions continuously into the inner peripheral wall.

8. The self-priming pump assembly according to claim 2, wherein:

the longitudinal axis, viewed in a direction of flow of the return line, is oriented radially toward the center of the pump assembly.

9. The self-priming pump assembly according to claim 2, wherein:

the first connection opening is positioned with reference to the pressure port such that a first arrangement plane that passes through a radial directional vector is penetrated at a right angle by a longitudinal axis of the pressure port, and the radial directional vector runs through a midpoint of the first connection opening and through a rotary axis of the pump assembly.

10. The self-priming pump assembly according to claim 2, wherein:

the first connection opening is positioned with reference to the pressure port such that a second arrangement plane that passes through a radial directional vector is penetrated at a right angle by a longitudinal axis of the pressure port, and the radial directional vector runs through a midpoint of the first connection opening and through an axial axis of symmetry of the housing casing.

11. The self-priming pump assembly according to claim 1, wherein:

the first connection opening toward the ring channel initially expands to form a countersink, and at least one of the bulge engages in the countersink in an axial direction, or the bulge extends through the countersink and thereby continuously expands the countersink toward the ring channel.

12. The self-priming pump assembly according to claim 11, wherein:

the countersink is formed axially symmetrical and coaxial to the longitudinal axis.

13. The self-priming pump assembly according to claim 1, wherein:

the longitudinal axis is arranged eccentrically offset to a radial area of extension of the lateral boundary surface, and radially offset inward.

14. The self-priming pump assembly according to claim 13, wherein:

the longitudinal axis is at a distance of up to one-half a diameter of the return line from the inner peripheral wall bordering the ring channel radially to the inside.

15. The self-priming pump assembly according to claim 1, wherein:

the longitudinal axis is perpendicular to, and in a contact point of a tangent to, the lateral boundary surface.

16. The self-priming pump assembly according to claim 15, further comprising:

a radially aligned lateral boundary surface, wherein an axis of symmetry of the bulge forms an angle with the longitudinal axis perpendicular to the lateral boundary surface, and an axial direction of extension of the bulge is oriented radially inward.

17. The self-priming pump assembly according to claim 16, wherein:

a low point of the bulge, viewed in a direction toward the center of the pump assembly, recedes inward behind the inner peripheral wall, and the transitional surface of the bulge transitions continuously into the inner peripheral wall.

18. The self-priming pump assembly according to claim 1, wherein:

the longitudinal axis, viewed in a direction of flow of the return line, is oriented radially toward the center of the pump assembly.

19. The self-priming pump assembly according to claim 1, wherein:

the first connection opening is positioned with reference to the pressure port such that a first arrangement plane that passes through a radial directional vector, which runs through a midpoint of the first connection opening and through a rotary axis of the pump assembly, is penetrated at a right angle by a longitudinal axis of the pressure port.

20. The self-priming pump assembly according to claim 1, wherein:

the first connection opening is positioned with reference to the pressure port such that a second arrangement plane that passes through a radial directional vector, which runs through a midpoint of the first connection opening and through an axial axis of symmetry of the housing casing, is penetrated at a right angle by a longitudinal axis of the pressure port.

* * * * *